US007728785B2

(12) United States Patent
Ozden

(10) Patent No.: US 7,728,785 B2
(45) Date of Patent: Jun. 1, 2010

(54) LOOP ANTENNA WITH A PARASITIC RADIATOR

(75) Inventor: Sinasi Ozden, Copenhagen (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/350,155

(22) Filed: Feb. 7, 2006

(65) Prior Publication Data

US 2007/0182658 A1 Aug. 9, 2007

(51) Int. Cl.
*H01Q 7/00* (2006.01)

(52) U.S. Cl. ..... 343/866

(58) Field of Classification Search ..... 343/866, 343/702, 748, 895, 700 MS; 455/575.1, 455/575.7
See application file for complete search history.

(56) References Cited

U.S. PATENT DOCUMENTS

| | | | | |
|---|---|---|---|---|
| 3,605,104 | A * | 9/1971 | Weston et al. | 343/837 |
| 4,644,364 | A * | 2/1987 | Parks | 343/825 |
| 4,866,453 | A * | 9/1989 | Nagy et al. | 343/712 |
| 5,198,826 | A * | 3/1993 | Ito | 343/726 |
| 5,406,297 | A * | 4/1995 | Caswell et al. | 343/741 |
| 5,627,550 | A | 5/1997 | Sanad | 343/700 |
| 5,680,144 | A | 10/1997 | Sanad | 343/700 |
| 5,767,813 | A * | 6/1998 | Verma et al. | 343/744 |
| 6,028,567 | A | 2/2000 | Lahti | 343/895 |
| 6,034,651 | A * | 3/2000 | Enguent | 343/895 |
| 6,236,368 | B1 * | 5/2001 | Johson | 343/702 |
| 6,249,255 | B1 | 6/2001 | Eggleston | 343/702 |
| 6,480,155 | B1 | 11/2002 | Eggleston | 343/700 |
| 6,707,428 | B2 | 3/2004 | Gram | 343/700 |
| 6,765,536 | B2 | 7/2004 | Phillips et al. | 343/702 |
| 6,885,342 | B2 * | 4/2005 | Saegrov et al. | 343/700 MS |
| 6,917,335 | B2 * | 7/2005 | Kadambi et al. | 343/700 MS |
| 6,917,339 | B2 | 7/2005 | Li et al. | 343/702 |
| 7,119,748 | B2 | 10/2006 | Autti | 343/702 |
| 7,298,338 | B2 | 11/2007 | Vesterinen | 343/702 |

(Continued)

FOREIGN PATENT DOCUMENTS

EP 0923-158 A2 6/1999

(Continued)

OTHER PUBLICATIONS

Virga, K.L., et al., "Low-Profile Enhanced-Bandwidth PIFA Antennas for Wireless Communications Packaging", IEEE Transactions on Microwave Theory and Techniques, vol. 45, No. 10, Oct. 1997, pp. 1879-1888.

*Primary Examiner*—Huedung Mancuso
(74) *Attorney, Agent, or Firm*—Harrington & Smith

(57) ABSTRACT

It is an objective of the present invention to provide an antenna construction that allows the thickness of an antenna structure be lower than that of planar antennas according to prior art without sacrificing the radiation efficiency at the desired RF-bands as 900 MHz GSM and 1800 MHz/1900 MHz DCS/PCS. A further object of the invention is to provide an antenna construction that is insensitive to changes in positions of electrically conductive objects in the vicinity. The objectives of the invention are achieved by a loop antenna structure equipped with an electrically conductive parasitic radiator that is electro-magnetically coupled with the antenna loop. Performance at the DCS/PCS bands can be further improved by using an electrically conductive tuner element that provides a stronger electromagnetic coupling between the antenna loop and the parasitic radiator.

22 Claims, 9 Drawing Sheets

U.S. PATENT DOCUMENTS

| | | | | |
|---|---|---|---|---|
| 2003/0206138 | A1* | 11/2003 | Chiu | 343/741 |
| 2004/0070548 | A1* | 4/2004 | Cake | 343/803 |
| 2004/0100413 | A1* | 5/2004 | Waldner | 343/742 |
| 2005/0153756 | A1* | 7/2005 | Sato et al. | 455/575.7 |
| 2005/0179604 | A1* | 8/2005 | Liu et al. | 343/742 |
| 2006/0038736 | A1 | 2/2006 | Hui et al. | 343/835 |
| 2006/0114159 | A1* | 6/2006 | Yoshikawa et al. | 343/702 |
| 2006/0220977 | A1* | 10/2006 | Ogino | 343/866 |
| 2007/0046542 | A1* | 3/2007 | Andrenko et al. | 343/700 MS |

FOREIGN PATENT DOCUMENTS

| | | | |
|---|---|---|---|
| EP | 1263079 | B1 | 4/2002 |
| JP | 2005-102183 | * | 4/2005 |

* cited by examiner

LOOP ANTENNA WITH A PARASITIC RADIATOR

FIELD OF THE INVENTION

The invention relates to antenna systems, and more particularly to loop antennas that can be used for example in personal mobile communication devices e.g. in a cellular mobile phone.

BACKGROUND OF THE INVENTION

Important technical properties of an antenna structure are physical size and radiation efficiency. For example, an antenna of a cellular mobile phone is nowadays usually located inside the cover of the phone device. Especially in folding mobile phones, e.g. in a clamshell type phone, the thickness of the antenna structure is an important quantity. This is due to the fact that a phone device should be thin enough also in a folded state. Another important issue is the radiation efficiency. The radiation efficiency means the ratio of the power supplied to an antenna to the power radiated by the antenna. Small radiation efficiency means increased power consumption when a desired level of radiated power is generated. The power consumption is a crucial issue especially in battery-energized devices like cellular mobile phones. In today's mobile phones an antenna may have to operate at several frequency bands. The frequency bands may be for example: 900 MHz GSM band, 1800 MHz band DCS (Digital Communication Service), and 1900 MHz PCS (Personal Communication Service) band. The radiated efficiency has to be good enough over all the frequency bands at which an antenna operates. Furthermore, it is advantageous if the radiating efficiency of an antenna at a desired frequency band is insensitive to existence of electrically conductive materials in the vicinity. For example in a folding phone application electromagnetic properties of the near-surroundings of an antenna depend in some extent on opening position of a phone mechanics.

DESCRIPTION OF THE PRIOR ART

A conventional antenna structure is a microstrip antenna comprising a ground plane and a radiator isolated therefrom by a layer of insulating material. The radio frequency signal, hereinafter RF-signal, is fed or taken between the radiator and the ground plane in a case of transmitting or receiving, respectively. A microstrip antenna provides usable radiation properties when operating at resonance frequencies of a system comprising the radiator and the ground plane. A planar inverted F-antenna, hereinafter PIFA, is shown in FIG. 1. In a PIFA-structure one edge of the radiator 101 is short-circuited via a conductor 104 on the ground plane 102. RF-signal is fed or taken between the radiator 101 and the ground plane 102 using a feed line 103. The advantage of the PIFA structure is the fact that a given resonance frequency can be achieved with considerably smaller physical dimensions than with the simplest microstrip antenna structure described above. An important design parameter of a PIFA structure is the distance h between the radiator and the ground plane. In other words, the thickness of an antenna plays a significant role when determining the radiation properties. Other issues that have influence on the properties of a PIFA are: dimensions of the radiator, location and dimensions of the short circuiting conductor between the radiator and the ground plane, and location of the feeding point at which the RF-signal is fed to the radiator. One PIFA can be made to support more than one resonance frequencies by e.g. dividing the radiator in parts by gaps. A typical feature of planar antenna structures according to prior art is a trade off between their thickness and the width of the frequency band giving usable radiation efficiency. For example, in a cellular mobile phone application the height of a PIFA antenna according to prior art has a considerable influence on the limits how thin the mobile phone can be. Another feature of a PIFA structure according to the prior art is the fact that the radiation efficiency at a certain frequency band is sensitive to changes in positions of electrically conductive objects in the vicinity; e.g. opening position of a folding phone. One limitation of PIFA technology is a so-called finger effect. In a mobile phone application user's fingers could cover a PIFA antenna and impair its performance.

A further development of a basic PIFA-structure is described in a reference publication by Virga and Rahmat-Samii, 1997: Low-Profile Enhanced-Bandwidth PIFA Antennas for Wireless Communication Packaging, in IEEE Transactions on Microwave Theory and Techniques, vol. 45 No 10, October, pages 1879-1888. A solution presented in the reference publication is shown in FIG. 2. In this solution the basic PIFA structure 201, 202, 203, and 204 is equipped with a planar auxiliary radiator 205 that is short-circuited 206 on the ground plane 202. The auxiliary radiator 205 is radiation coupled, rather than directly fed, to the main radiator 201. Another solution described in the reference publication is such that the auxiliary radiator is coupled to the main radiator with diodes. Altering the small-signal operating point of these diodes varies the properties of an antenna. Nevertheless, also in these solutions the distance of the main radiator from the ground plane is a significant design parameter thus stating a need for compromise between the thickness and the properties of an antenna. In an example design presented in the reference publication the distance h is 12.90 mm that is too much for today's cellular mobile phones.

A loop antenna is a resonator system in which inductances of the loop and external capacitors or/and parasitic capacitances of the loop make it resonate at a desired frequency. A conventional loop antenna structure that can be used within a cellular mobile phone is shown in FIG. 3. An antenna loop 306 is made of strip type electrical conductor 303 whose length, width, and layout on a circuit board has been designed to produce desired radiation properties. The antenna loop has one or more electrically conductive paths 301, 302 (dashed lines) between electrical terminals 304 and 305. An RF-signal is fed or taken between the terminals 304, 305 in a case of transmitting or receiving, respectively. A loop antenna can be designed to support more than one resonance frequencies with many parallel-connected paths having different geometrical dimensions. A loop antenna provides usable radiation properties when operating at its resonance frequencies. An attractive feature of a loop antenna compared with a planar one is the fact that the thickness of the antenna is not a design parameter in a same way. Therefore, a loop antenna can be made significantly thinner than a planar antenna. A loop antenna has normally very good radiation efficiency at low frequency bands ~800-950 MHz. A problem with the loop antennas according to prior art is the fact that they suffer from low radiation efficiency at high frequency bands ~1800-1950 MHz. Another negative feature of a loop antenna structure according to the prior art is the fact that the radiation efficiency at a certain frequency band is sensitive to changes in positions of electrically conductive objects in the vicinity; e.g. opening position of a folding phone.

One prior-art technique is to use one or more helix or rod antennas to cover the appropriate frequency bands. However, helix and rod antenna constructions are difficult to realize inside a housing of a mobile communication device like today's mobile phone.

In the view of various inherent limitations of antennas according to prior art, it would be desirable to avoid or mitigate these and other problems associated with prior art.

BRIEF DESCRIPTION OF THE INVENTION

It is an objective of the present invention to provide an antenna construction that allows the thickness of an antenna structure be smaller than that of planar antennas according to prior art without sacrificing the radiation efficiency at the desired RF-bands as 900 MHz GSM and 1800 MHz/1900 MHz DCS/PCS. A further object of the invention is to provide an antenna construction that is less sensitive to changes in positions of electrically conductive objects in the vicinity, e.g. to opening position of a folding phone, than planar antennas according to prior art. It also an object of the invention provide a mobile communication device having an antenna structure that is inside a cover part of said mobile communication device so that the thickness of an antenna structure can be smaller than that of planar antennas according to prior art without sacrificing the radiation efficiency at the desired RF-bands as 900 MHz GSM and 1800 MHz/1900 MHz DCS/PCS.

The objectives of the invention are achieved by a loop antenna structure equipped with an electrically conductive parasitic radiator. From a viewpoint of transmitting operation the electrically conductive parasitic radiator receives RF-electromagnetic energy from the antenna loop via an mutual electromagnetic coupling between the antenna loop and the parasitic radiator over an electrically insulating area and emits a part of the received electromagnetic energy in a form of RF-electromagnetic radiation to the surrounding space. From a viewpoint of receiving operation the electrically conductive parasitic radiator captures RF-electromagnetic energy from RF-electromagnetic radiation falling to the parasitic radiator and transfers a part of the captured RF-electromagnetic energy to the antenna loop via the mutual electromagnetic coupling. The problem associated with low radiation efficiency of a loop antenna at 1800 MHz/1900 MHz DCS/PCS bands is solved with the aid of the parasitic radiator that boosts performance at those frequency bands.

The distance between the antenna loop and the parasitic radiator is typically 0-20 mm and advantageously 1-6 mm. The lower limit of the distance (0 mm) means that there may be one or more cantilevered portion in the parasitic radiator and/or in the antenna loop so that there is a physical contact between the antenna loop and the parasitic radiator. In this document a distance between two objects is defined to be the minimum physical distance between surfaces of the objects. The upper limit of the distance comes from the fact that a too long a distance would make the electromagnetic coupling between the parasitic radiator and the antenna loop too weak and, naturally, making the distance longer increases the size of an antenna system.

Performance at the DCS/PCS bands can be further improved by using a dedicated electrically conductive tuner element that provides stronger electrical coupling between the antenna loop and the parasitic radiator. The distance between the tuner element and the antenna loop is typically class 0-20 mm, and advantageously class 0-4 mm. The distance between the tuner element and the parasitic radiator is typically class 0-20 mm, and advantageously class 0-4 mm.

In this document a term 'electrical coupling' comprises at least coupling via electric and magnetic fields over an electrically insulating area but in conjunction with certain embodiments of the invention it may also comprise a galvanic coupling.

The properties of an antenna are mainly determined by the geometry of the loop forming the main patch of the antenna, the geometry of the parasitic radiator, the geometry of the tuner element if exists, and the mutual positions of these elements respect to each other. The radiation efficiency is a function of the frequency. The local maximums of this function are arranged to desired frequency bands (e.g. 900 MHz, 1800 MHz, 1900 MHz) by designing the resonances of the main patch and the parasitic radiator to the desired frequency bands.

Suitable shapes and mutual positions of a main patch, a parasitic radiator, and a possible tuner element can be sought with e.g. experimental prototype tests and/or with simulations. The simulations may be accomplished e.g. with the finite-difference time-domain (FDTD) method (A. Taflove, Computational Electrodynamics: The Finite-Difference Time-Domain Method. Norwood. Mass.: Artech House, 1995).

The invention yields appreciable benefits compared to prior art solutions:

- The invention improves the radiation efficiency of a loop antenna at 1800 MHz/1900 MHz DCS/PCS. This is an important improvement for loop antennas normally having low efficiency at the high frequency bands.
- The solution of the invention allows the thickness of an antenna to be reduced without compromising the radiation efficiency at the desired RF-bands as 900 MHz GSM and 1800 MHz/1900 MHz DCS/PCS.
- The solution of the invention reduces the sensitivity of the radiating efficiency at a desired frequency band to existence of electrically conductive materials in the vicinity. This is an important property for example in a folding phone application in which electromagnetic properties of the near-surroundings of an antenna depends in some extent on an opening position of a phone mechanics.
- The solution of the invention allows reducing the size of the antenna loop thus contributing to a miniaturization of the antenna.

A loop antenna arrangement according to the invention is characterized in that the antenna arrangement comprises:

- a first electrical terminal and a second electrical terminal,
- an electrical conductor forming an antenna loop having at least one electrically conductive path extending from the first electrical terminal to the second electrical terminal, and
- an electrically conductive parasitic radiator being in the vicinity of the antenna loop, the distance between the antenna loop and the parasitic radiator being typically 0-20 mm, advantageously 1-6 mm.

A loop antenna system according to the invention is characterized in that the antenna system comprises:

- a first electrical terminal and a second electrical terminal between which RF-signal is fed into the loop antenna system or received from the loop antenna system,
- an electrical conductor forming an antenna loop connected between the first electrical terminal and the second electrical terminal, the antenna loop emitting RF-electromagnetic radiation to surrounding space when RF-voltage is coupled between the first electrical terminal and the second electrical terminal, and the antenna loop forming RF-voltage between the first electrical terminal and the second electrical terminal when RF-electromagnetic radiation falls to the antenna loop, and an electrically conductive parasitic radiator disposed to receive RF-electromagnetic energy from the antenna loop via an mutual electromagnetic coupling over an electrically insulating area, and to emit a part of the received electromagnetic energy in a form of RF-electromagnetic radiation to the surrounding space, and to capture RF-electromagnetic energy from RF-electromagnetic radiation falling to the parasitic radiator, and to transfer a part of the captured RF-electromagnetic energy to the antenna loop via the mutual electromagnetic coupling over an electrically insulating area.

A mobile communication device according to the invention is characterized in that the mobile communication device comprises:

a first electrical terminal and a second electrical terminal between which an RF-signal transmitted from the mobile communication device is fed and between which an RF-signal received at the mobile communication device is detected, an electrical conductor forming an antenna loop connected between the first electrical terminal and the second electrical terminal, the antenna loop emitting RF-electromagnetic radiation to surrounding space when RF-voltage is coupled between the first electrical terminal and the second electrical terminal, and the antenna loop forming RF-voltage between the first electrical terminal and the second electrical terminal when RF-electromagnetic radiation falls to the antenna loop, and an electrically conductive parasitic radiator disposed to receive RF-electromagnetic energy from the antenna loop via an mutual electromagnetic coupling over an electrically insulating area, and to emit a part of the received electromagnetic energy in a form of RF-electromagnetic radiation to the surrounding space, and to capture RF-electromagnetic energy from RF-electromagnetic radiation falling to the parasitic radiator, and to transfer a part of the captured RF-electromagnetic energy to the antenna loop via the mutual electromagnetic coupling over an electrically insulating area.

Features of various advantageous embodiments of the invention are listed in the appended depending claims.

The exemplary embodiments of the invention presented in this document are not to be interpreted to pose limitations to the applicability of the appended claims. The verb "to comprise" is used in this document as an open limitation that does not exclude the existence of also unrecited features. The features recited in depending claims are mutually freely combinable unless otherwise explicitly stated.

BRIEF DESCRIPTION OF THE FIGURES

The invention and its other advantages are explained in greater detail below with reference to the preferred embodiments presented in a sense of examples and with reference to the accompanying drawings, in which.

DETAILED DESCRIPTION OF THE PREFERRED EMBODIMENTS OF THE INVENTION

Figure 1:
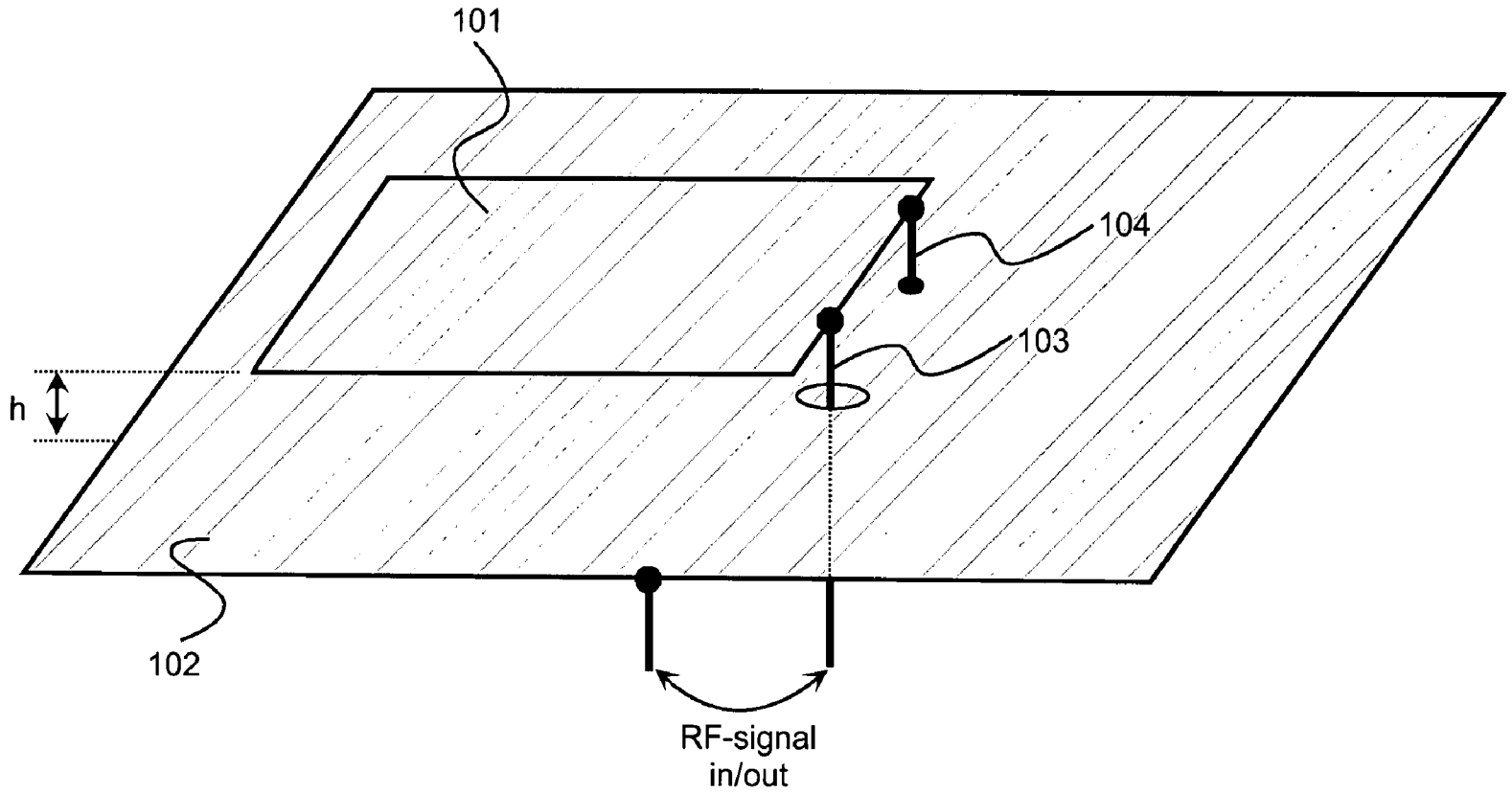
Figure 1 Prior art
FIG. 1 shows a PIFA-antenna according to prior art.
Figure 2:
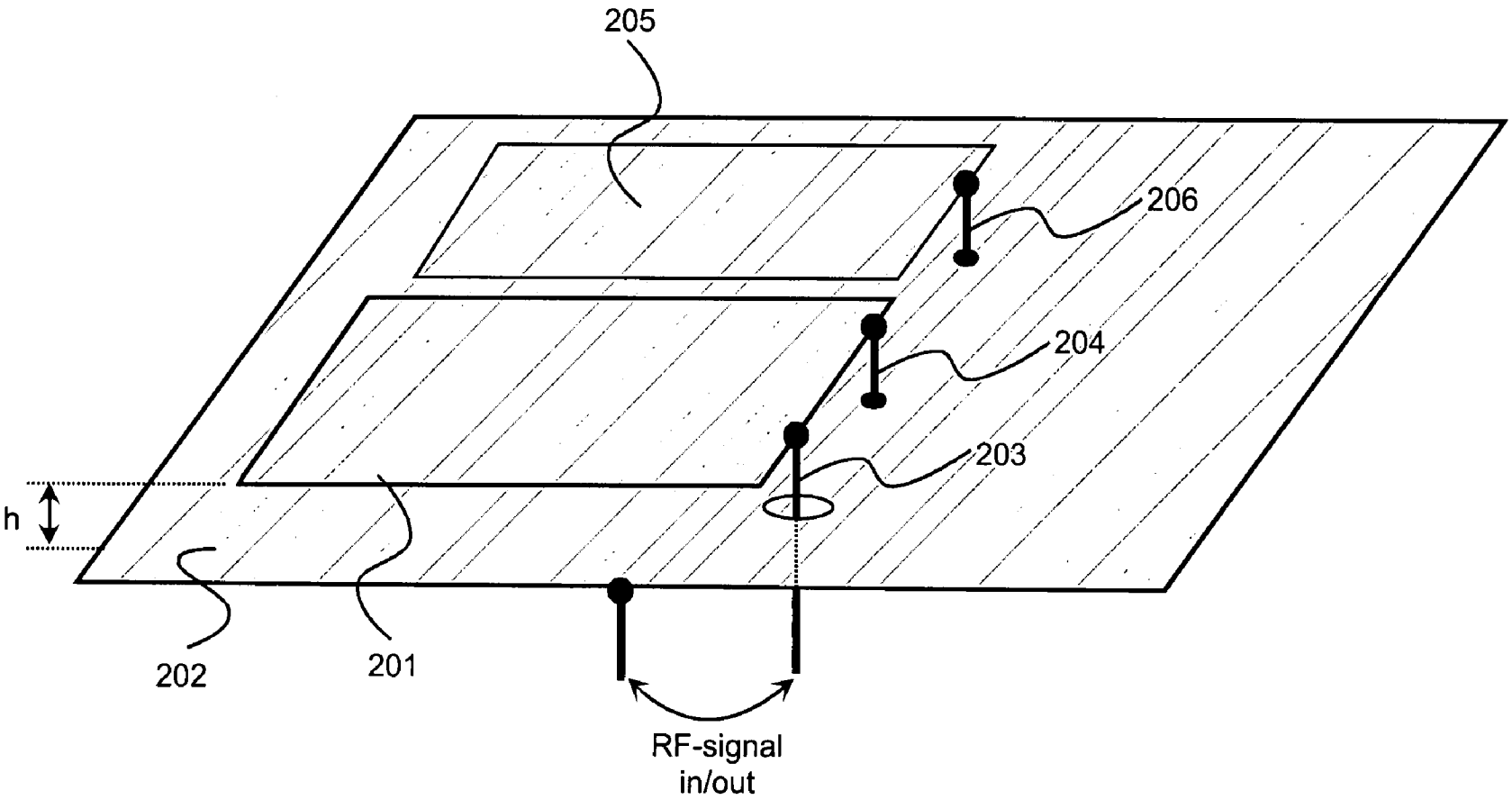
Figure 2 Prior art
FIG. 2 shows a variation of a PIFA-antenna according to prior art.
Figure 3:
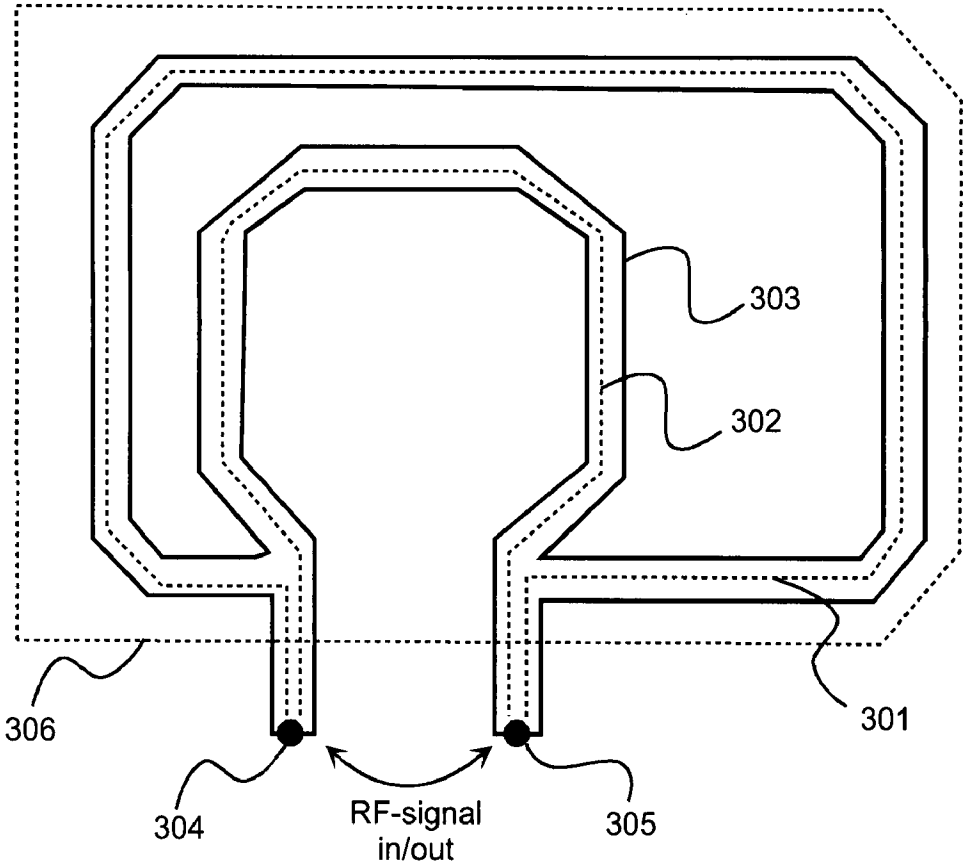
Figure 3 Prior art
FIG. 3 shows a loop antenna according to prior art.

FIGS. 1-3 have been explained above in the description of the prior art.

Figure 4:
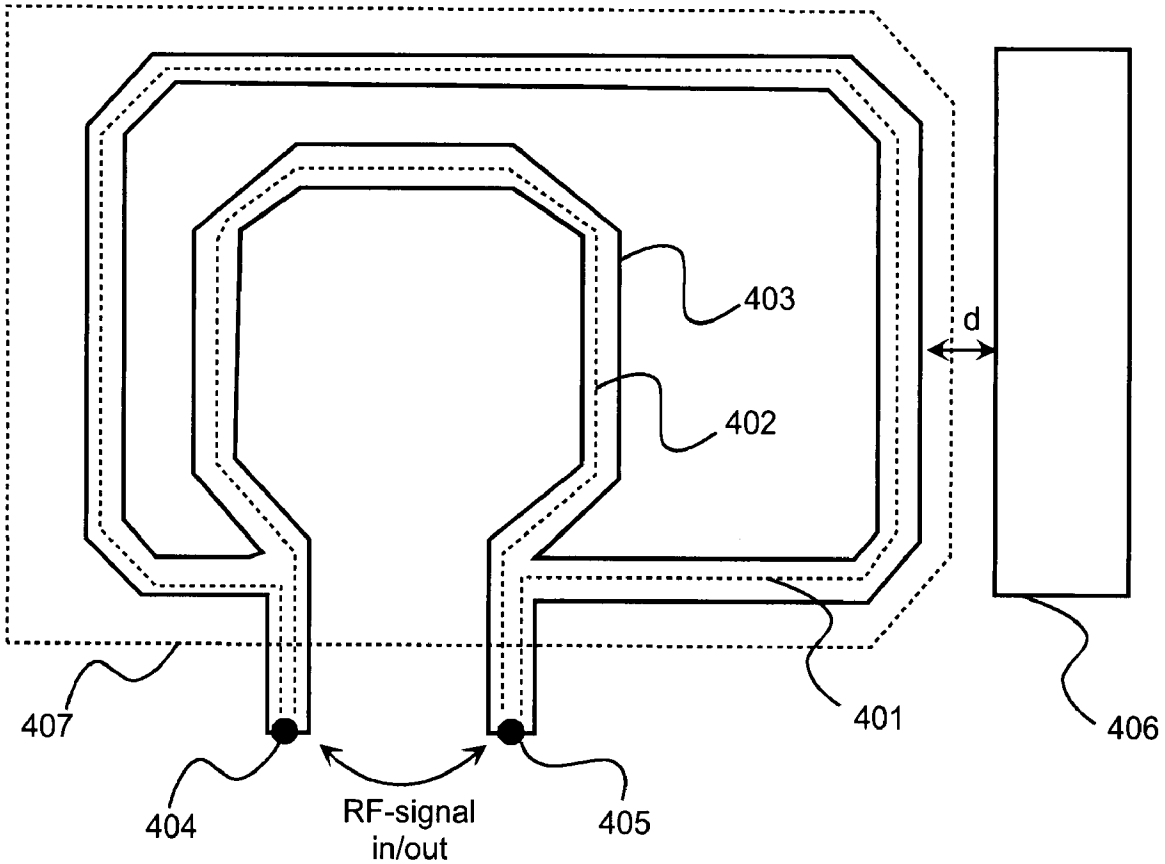
FIG. 4 shows a loop antenna equipped with a parasitic radiator according to an embodiment of the invention.

FIG. 4 shows a loop antenna equipped with an electrically conductive parasitic radiator according to an exemplary embodiment of the invention. A strip type electrical conductor 403 forms an antenna loop 407 having two parallel paths between the RF-input and output terminals 404 and 405. Dashed lines 401 and 402 present the routes of the paths. A parasitic radiator 406 made of conductive sheet is located in the vicinity of the antenna loop 408. In this embodiment of the invention the characteristics of the antenna structure can be adjusted by altering the number, sizes, and routes of the electrically conductive paths like 401 and 402, by altering the shape of the parasitic radiator 406, and by altering the position of the parasitic radiator 406 with respect to the antenna loop 407, for example varying the distance d between the antenna loop 407 and the parasitic radiator 406. An advantageous design can be found with prototype experiments and/or with simulations such that resonance frequencies and/or bandwidth and/or some other property of the antenna structure, such as antenna impedance at the feed points 404, 405, for example, are as desired.

Figure 5:
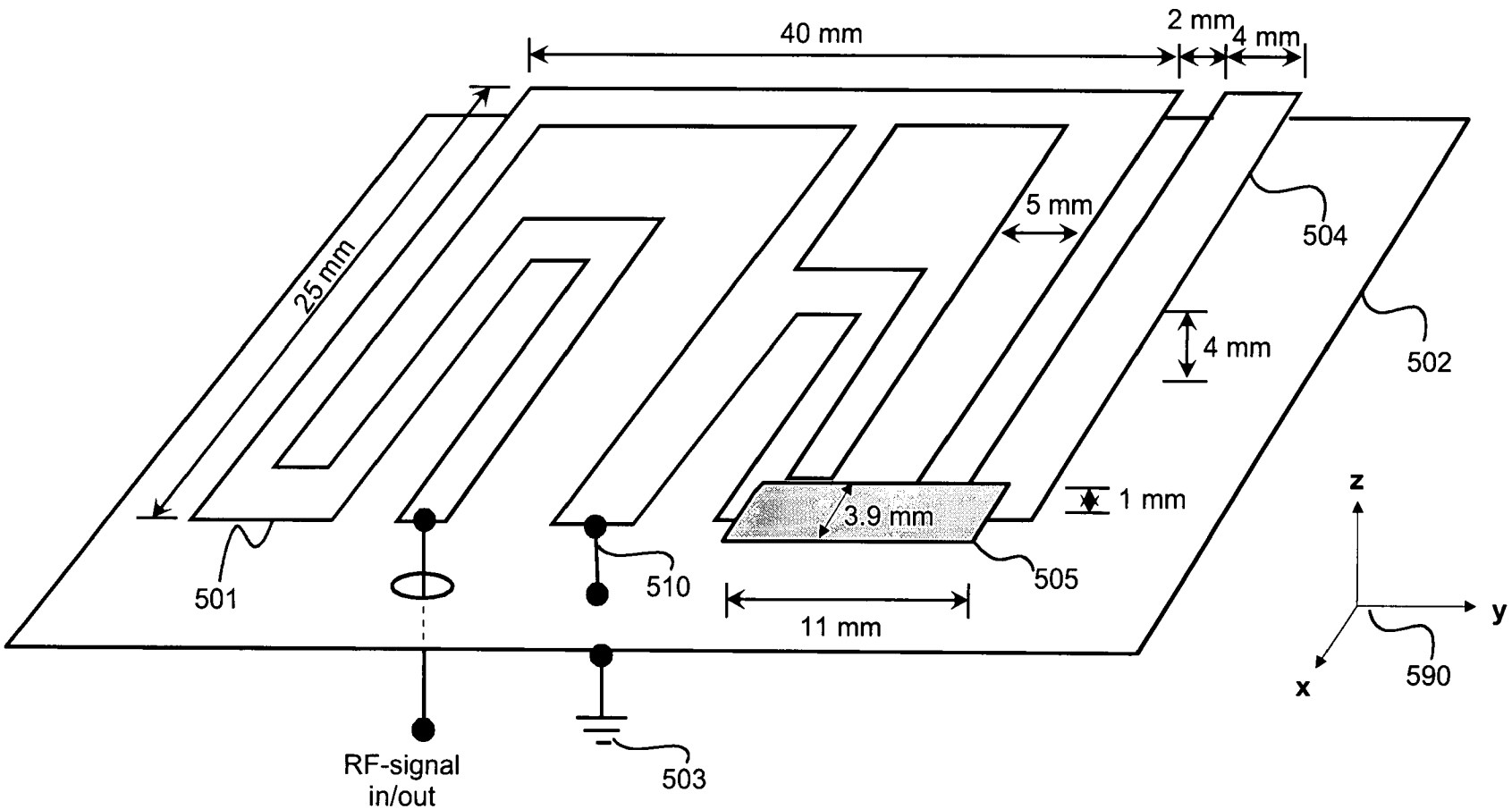
FIG. 5 shows a loop antenna equipped with a parasitic radiator and with a tuner element according to an embodiment of the invention.

FIG. 5 shows a perspective view of a loop antenna equipped with an electrically conductive parasitic radiator, an electrically conductive tuner element, and a ground plane according to a preferred embodiment of the invention. An x, y, z-coordinate system 590 is shown in FIG. 5 for the sake of illustrative purposes. The loop antenna according to this embodiment of the invention comprises an electrically conductive part 502 that is electrically connected to a signal ground 503. Therefore, a surface of the electrically conductive part 502 constitutes a ground plane for an antenna loop 501 and for a parasitic radiator 504. The loop antenna can be fed with a non-differential RF-signal because an electrical terminal 510 of the antenna loop 501 is connected to the ground plane 502. The tuner element 505 is used to increase the capacitive coupling between the antenna loop 501 and the parasitic radiator 504. In this embodiment the tuner element 505 forms a capacitor together with a portion of a surface of the antenna loop 501 and another capacitor together with a portion of a surface of the parasitic radiator 504. The strength of the capacitive coupling can be varied by varying the areas of the surfaces facing towards each other and by varying the distances between the surfaces facing towards each other. This embodiment of the invention with mechanical dimensions presented in FIG. 5 has been used for measurement tests. In the tests the outer dimensions of the antenna loop are 25×40 mm. The y-directional distance between the antenna loop and the parasitic radiator is 2 mm. The z-directional distance between the antenna loop and the ground plane is 4 mm and also the z-directional distance between the parasitic radiator and the ground plane is 4 mm. Therefore, the thickness of the antenna shown in FIG. 5 is 4 mm. The arm of the antenna loop connecting to the parasitic radiator and influencing the parasitic resonance is 5 mm in width and 25 mm in length. The parasitic radiator resonates at 1800 MHz DCS band and is 4 mm in width and 25 mm in length. The tuner element is 11 mm in length and 3.9 mm in width. The z-directional distance between the antenna loop and the tuner element is 1 mm and also the z-directional distance between the parasitic radiator and the tuner element is 1 mm. The measured values for the radiation efficiency (η) obtained for a case when a folding mobile phone, e.g. a clamshell type phone, is in an open state and for another case when it is in a closed state are shown in the table below.

| | Band = | | |
|---|---|---|---|
| | GSM/900 MHz | DCS/1800 MHz | PCS/1900 MHz |
| Open | η = 66% | η = 82% | η = 76% |
| Closed | η = 46% | η = 72% | η = 73% |

As can be seen from the measured results acceptably good radiation efficiency values may be obtained with a loop antenna structure as thin as 4 mm. For comparison, planar inverted f-antenna (PIFA) technology according to prior art has been used and developed for more than five years for mobile phones, but still an effective height of a PIFA has to be at least 7 mm.

Another advantage is the fact that the radiation efficiency at the high band (DCS/PCS) is not significantly worse in the closed mode than in the open mode because of the parasitic radiator and the tuner effect. This kind of situation is difficult to reach with both PIFAs and loop antennas according to prior art.

Figure 6:
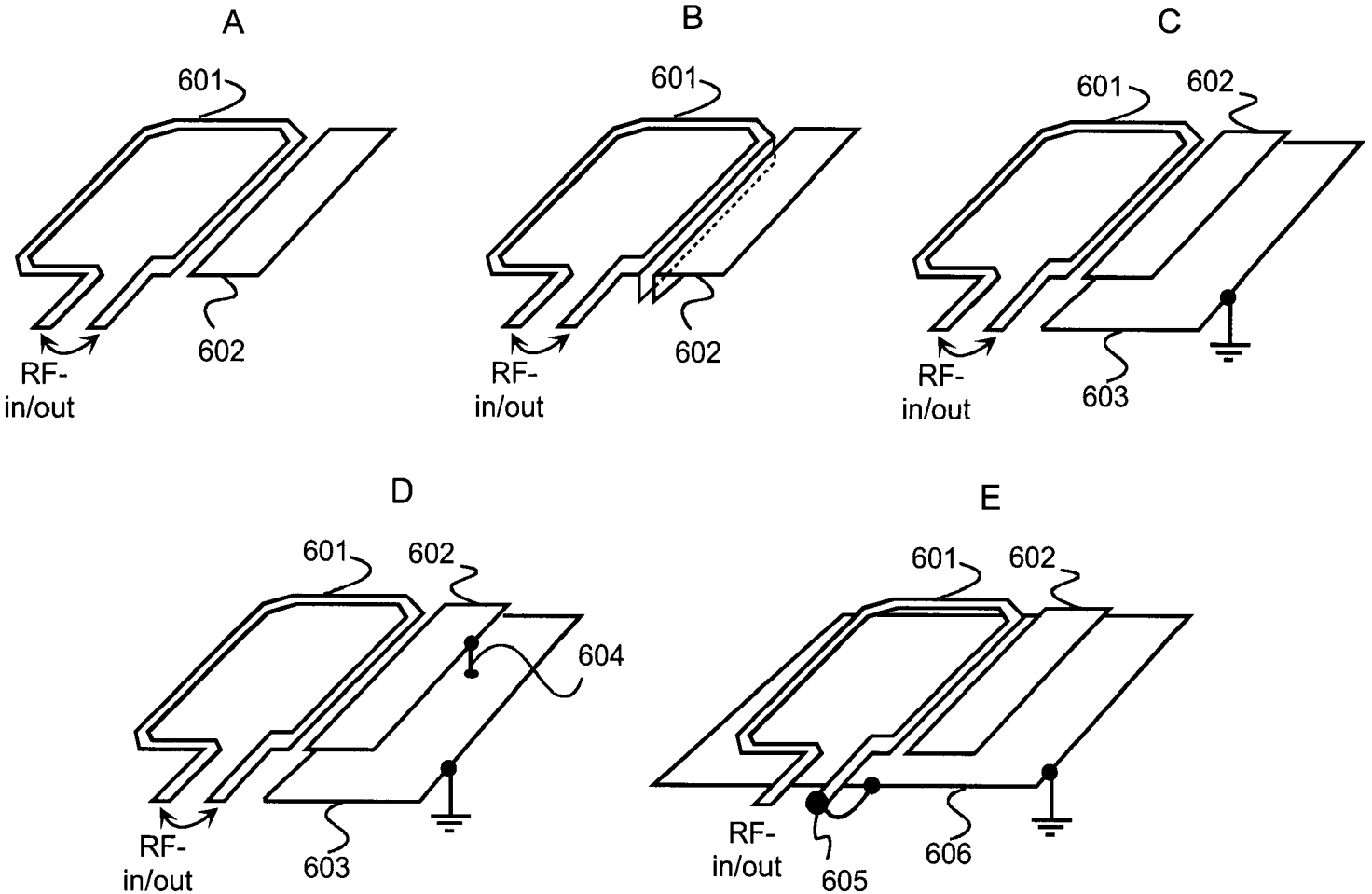
FIGS. 6 and 7 show different antenna loop—parasitic radiator arrangements according to different embodiments of the invention.

FIG. 6 illustrates examples of mutual placements of an antenna loop 601 and a parasitic radiator 602 according to different embodiments of the invention. In example A an electromagnetic coupling between the antenna loop and the parasitic radiator is mainly inductive-type because of the fact that practically there are no surfaces facing towards each other in the antenna loop and in the parasitic radiator. In example B the capacitive coupling has been made stronger by bending a portion of the antenna loop and a portion of the parasitic radiator to face towards each other. In example C there is an electrically conductive part 603 a surface of which constitutes a ground plane for the parasitic radiator. The parasitic radiator and the ground plane form a capacitor the capacitance of which is easier to control in a design process than the capacitance of the parasitic radiator with respect to other electrically conductive elements in the vicinity of the antenna system e.g. electrically conductive materials that do not belong to the antenna system but are inside a mobile phone. In example D the parasitic radiator is in galvanic contact 604 with the ground plane. In a general case there may be more than one galvanic contact. In example E an electrical terminal 605 of the antenna loop 601 is electrically connected to an electrically conductive part 606 a surface of which constitutes a ground plane for both the antenna loop and the parasitic radiator. The antenna loop and the ground plane form a capacitor the capacitance of which is easier to control in a design process than the capacitance of the antenna loop with respect to other electrically conductive elements in the vicinity of the antenna system. Furthermore, the antenna system according to example E can be fed with a non-differential RF-signal. With the ground plane arrangements it is possible to affect the characteristics of the antenna structure by altering the distance between the ground plane and the parasitic radiator and/or the distance between the ground plane and the antenna loop. In the antenna system according to example D it is possible to affect the characteristics of the antenna structure by altering the location of the point of the galvanic connection 604 at the parasitic radiator. A perpendicular distance between the ground plane and a loop surface determined by the antenna loop does not have to be constant over said loop surface. The ground plane can be non-flat and/or positioned in a way that said perpendicular distance is non-constant over said loop surface. The same is valid for the parasitic radiator too. There are no general closed-form equations with the aid of which it would be, for example, possible to predict how the resonance frequencies are changing when the ground plane is moved closer or farther with respect to the parasitic resonator and/or with respect to the antenna loop. An optimal solution is typically sought with prototype measurements and/or with simulations.

Figure 7:
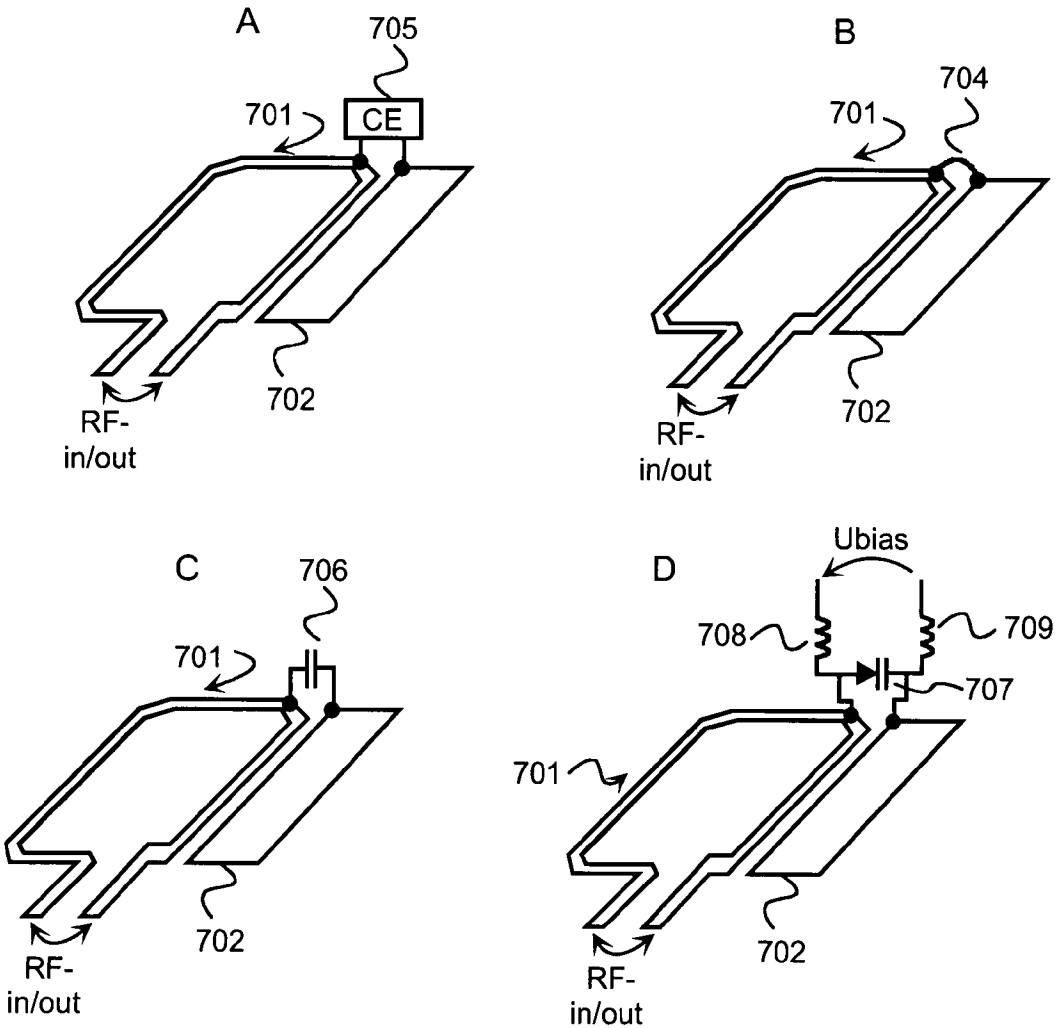

Example A in FIG. 7 shows an exemplary embodiment of the invention in which characteristics of an antenna structure are affected by using a coupling element 705 between an antenna loop 701 and a parasitic radiator 702. A coupling element 705 may comprise active and/or passive electrical components. In a general case, there can be one or more coupling elements. In example B the coupling element is a low-impedance galvanic contact 704. In example C the coupling element is a capacitor 706 with the aid of which the coupling between the antenna loop and the parasitic radiator can be made to have a strong capacitive nature. In example D there is an active electrical component as the coupling element. A capacitance diode 707 acts as the coupling element and its small-signal capacitance value is controlled with a dc-bias voltage Ubias fed via ac-decoupling coils 708 and 709.

Figure 8:
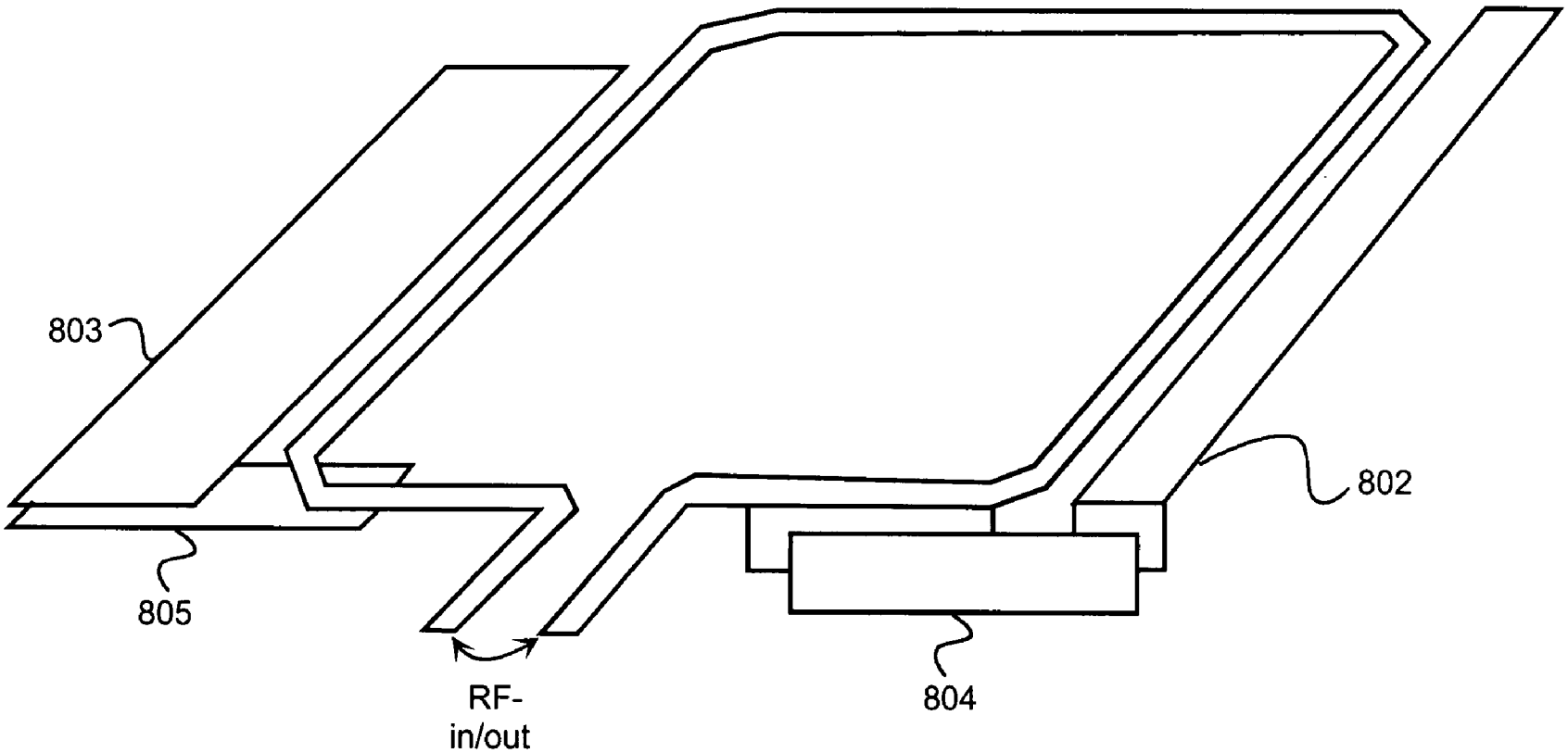
FIG. 8 shows an exemplary embodiment of the invention in which there are two parasitic radiators and two tuner elements.

FIG. 8 shows an exemplary embodiment of the invention in which there are two parasitic radiators 802 and 803 and two tuner elements 804 and 805. Tuner element 804 is oriented in a similar way as the tuner in FIG. 5. Tuner element 805 is parallel to an imaginary plane comprising the antenna loop and the parasitic radiators. By using more than one parasitic radiator we can increase the number of free design parameters. This can be utilized e.g. if we want to increase the number of resonance frequencies of the antenna structure or if we try to circumvent a harmful trade off associated with a value of a certain design parameter. In this context we mean by design parameters geometrical dimensions and mutual positions of the antenna loop, parasitic radiator(s), tuner element(s), and a ground plane, and also electrical characteristics of possible coupling element(s) (705).

The features shown in FIGS. 6, 7, and 8 can be freely combined into a single embodiment of the invention. For example, a certain exemplary embodiment of the invention can have more than one parasitic radiators, more than one tuner elements, a ground plane, coupling elements between the antenna loop and the parasitic radiators, and galvanic connections between the parasitic radiators and the ground plane.

Figure 9:
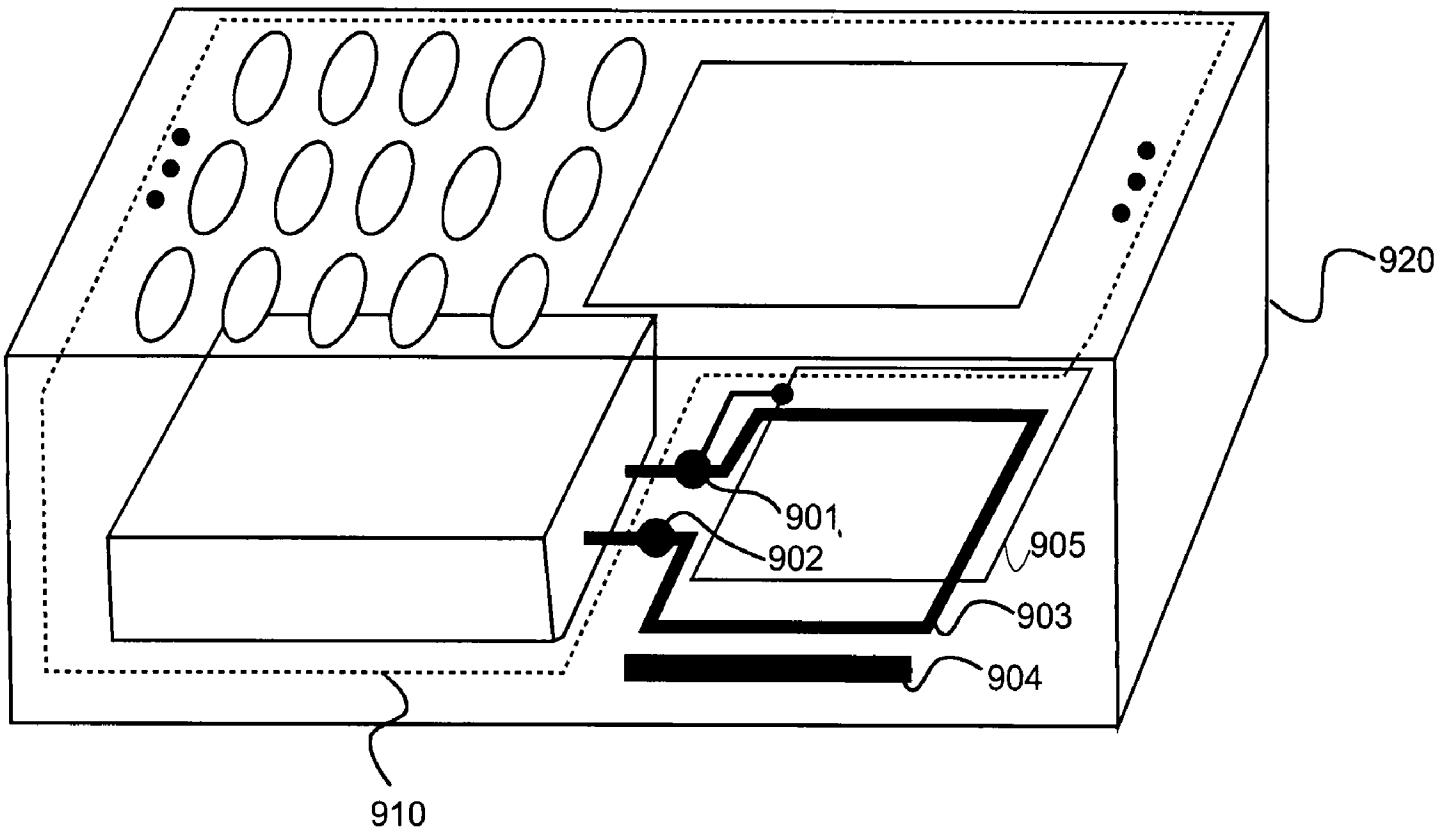
FIG. 9 shows a mobile communication device according to an embodiment of the invention.

A mobile communication device according to an embodiment of the invention is shown in FIG. 9. The mobile communication device comprises a first electrical terminal 901 and a second electrical terminal 902 between which an RF-signal transmitted from the mobile communication device is fed and between which an RF-signal received at the mobile communication device is detected. The mobile communication device comprises an electrical conductor 903 forming an antenna loop connected between the first electrical terminal 901 and the second electrical terminal 902. In FIG. 9, a cover part 920 of the mobile communication device is presented as a transparent object for the sake of illustrative purposes. The antenna loop is disposed to emit RF-electromagnetic radiation to surrounding space when RF-voltage is coupled between the first electrical terminal and the second electrical terminal. The antenna loop forms RF-voltage between the first electrical terminal and the second electrical terminal when RF-electromagnetic radiation falls to the antenna loop. The mobile communication device comprises an electrically conductive parasitic radiator 904 disposed to receive RF-electromagnetic energy from the antenna loop via an mutual electromagnetic coupling over an electrically insulating area, and to emit a part of the received electromagnetic energy in a form of RF-electromagnetic radiation to the surrounding space, and to capture RF-electromagnetic energy from RF-electromagnetic radiation falling to the parasitic radiator, and to transfer a part of the captured RF-electromagnetic energy to the antenna loop via the mutual electromagnetic coupling over an electrically insulating area. The mobile communication device may comprise an electrically conductive part 905 a surface of which constitutes a ground plane for the antenna loop and/or for the electrically conductive parasitic radiator 904. The ground plane can be electrically connected to the first electrical terminal 901 or to the second electrical terminal 902. In FIG. 9, the electrically conductive part 905 that constitutes the ground plane is electrically connected to the first electrical terminal 901 and it is presented as a transparent object for the sake of illustrative purposes. Parts surrounded by a dashed line 910 are elements of the mobile communication device that generate the RF-signal to be transmitted from the mobile communication device and parts that perform processing of the RF-signal received from the first and the second electrical terminals 901 and 902. Generating the RF-signal to be transmitted may be, for example, conversion of a voice signal received at a microphone to an electrical signal the spectrum of which belongs to the RF-area. Correspondingly, processing of the RF-signal received from the first and the second electrical terminals 901 and 902 may be, for example, conversion of said RF-signal to a voice signal.

The mobile communication device can be e.g. a mobile phone or a palmtop computer.

Any of the elements: an antenna loop, a parasitic radiator, and a tuner element can be made of unitary metal part. They can be etched or cut, for example from a thin sheet of metal. An antenna structure can be constructed on a dielectric (plastic) circuit board as PWB (printed wiring board). A circuit board has not been presented in the attached figures. An antenna loop does not have to be in a plane. The conductor forming an antenna loop may have curves towards any direction seen appropriate. Neither a parasitic radiator has to be planar as illustrated e.g. in FIG. 8. Also a tuner element may have a non-planar shape.

It is obvious to a person skilled in the art that the invention and its embodiments are thus not limited to the above-described examples, but may vary within the scope of the attached claims.

I claim:

1. An antenna arrangement comprising:

a first electrical terminal and a second electrical terminal, an electrical conductor forming an antenna loop having at least one electrically conductive path extending from the first electrical terminal to the second electrical terminal, the antenna loop being configured to operate as a loop antenna, an electrically conductive parasitic radiator in a substantially co-planar arrangement with the antenna loop, the electrically conductive parasitic radiator being arranged to couple with the antenna loop, said electrically conductive parasitic radiator having a length that is approximately one quarter of a wavelength at an operating frequency, and an electrically conductive tuner element in the vicinity of the antenna loop and the electrically conductive parasitic radiator, the distance between the electrically conductive tuner element and the antenna loop being at a distance to increase capacitive coupling between the antenna loop and the parasitic radiator.

2. An antenna arrangement according to claim 1, wherein the distance between the electrically conductive tuner element and the antenna loop is no greater than 20 mm, and the distance between the electrically conductive tuner element and the electrically conductive parasitic radiator is no greater than 20 mm.

3. An antenna arrangement according to claim 1, further comprising an electrically conductive part a surface of which is disposed to constitute a ground plane for at least one of the following: the antenna loop and the electrically conductive parasitic radiator.

4. An antenna arrangement according to claim 3, further comprising a galvanic coupling between the ground plane and the electrically conductive parasitic radiator.

5. An antenna arrangement according to claim 1, wherein there are more than one electrically conductive parasitic radiator.

6. An antenna arrangement according to claim 5, wherein there are more than one electrically conductive tuner element.

7. An antenna arrangement according to claim 1, wherein the distance between the antenna loop and the parasitic radiator is no greater than 20 mm.

8. An antenna arrangement according to claim 1, wherein the distance between the antenna loop and the parasitic radiator is no greater than 6 mm.

9. An antenna arrangement according to claim 1, wherein the antenna arrangement is configured for use in a mobile communication device.

10. An antenna arrangement comprising:

a first electrical terminal and a second electrical terminal, an electrical conductor forming an antenna loop having at least one electrically conductive path extending from the first electrical terminal to the second electrical terminal, the antenna loop being configured to operate as a loop antenna, an electrically conductive parasitic radiator in a substantially co-planar arrangement with the antenna loop, the electrically conductive parasitic radiator being arranged to couple with the antenna loop, said electrically conductive parasitic radiator having a length that is approximately one quarter of a wavelength at an operating frequency, and further comprising a coupling element connecting the electrically conductive parasitic radiator to the antenna loop, the coupling element comprising at least one of a passive electrical component, an active electrical component, and both passive and active electrical components.

11. An antenna arrangement comprising:

a first electrical terminal and a second electrical terminal between which RF-signal is fed into the antenna arrangement or received from the antenna arrangement, an electrical conductor forming an antenna loop having at least one electrically conductive path extending from the first electrical terminal to the second electrical terminal, the antenna loop being configured to operate as a loop antenna that is arranged to emit RF-electromagnetic radiation to surrounding space when RF-voltage is coupled between the first electrical terminal and the second electrical terminal, and to form RF-voltage between the first electrical terminal and the second electrical terminal when RF-electromagnetic radiation falls to the antenna loop, an electrically conductive parasitic radiator disposed to receive RF-electromagnetic energy from the antenna loop via an mutual electromagnetic coupling over an electrically insulating area, and to emit a part of the received electromagnetic energy in a form of RF-electromagnetic radiation to the surrounding space, and to capture RF-electromagnetic energy from RF-electromagnetic radiation falling to the electrically conductive parasitic radiator, and to transfer a part of the captured RF-electromagnetic energy to the antenna loop via the mutual electromagnetic coupling over an electrically insulating area, wherein the electrically conductive parasitic radiator is in a substantially co-planar arrangement with the antenna loop, said electrically conductive parasitic radiator having a length that is approximately one quarter of a wavelength at an operating frequency, and an electrically conductive tuner element disposed to mediate RF-electromagnetic energy between the antenna loop and the electrically conductive parasitic radiator via electrical coupling between the electrically conductive tuner element and the antenna loop and via electrical coupling between the electrically conductive tuner element and the electrically conductive parasitic radiator.

12. An antenna arrangement according to claim 11, wherein at least one of the electrical coupling between the electrically conductive tuner element and the antenna loop, the electrical coupling between the electrically conductive tuner element and the electrically conductive parasitic radiator;

is realized as electric and magnetic field coupling over an electrically insulating area.

13. An antenna arrangement according to claim 11, wherein at least one of the electrical coupling between the electrically conductive tuner element and the antenna loop, the electrical coupling between the electrically conductive tuner element and the electrically conductive parasitic radiator;

comprises a galvanic coupling via an electrically conductive area.

14. An antenna arrangement according to claim 11, further comprising an electrically conductive part a surface of which is disposed to constitute a ground plane for at least one of the following: the antenna loop and the electrically conductive parasitic radiator.

15. An antenna arrangement according to claim 14, further comprising a galvanic coupling between the ground plane and the electrically conductive parasitic radiator.

16. An antenna arrangement according to claim 11, further comprising a coupling element connecting the electrically conductive parasitic radiator to the antenna loop, the coupling element comprising at least one of a passive electrical component, an active electrical component, and both passive and active electrical components.

17. An antenna arrangement according to claim 11, wherein there are more than one electrically conductive parasitic radiator.

18. An antenna arrangement according to claim 17, wherein there are more than one electrically conductive tuner element.

19. A mobile communication device comprising:

a first electrical terminal and a second electrical terminal between which an RF-signal transmitted from the mobile communication device is fed and between which an RF-signal received at the mobile communication device is detected, an electrical conductor forming an antenna loop having at least one electrically conductive path extending from the first electrical terminal to the second electrical terminal, the antenna loop being configured to operate as a loop antenna that is arranged to emit RF-electromagnetic radiation to surrounding space when RF-voltage is coupled between the first electrical terminal and the second electrical terminal and to form RF-voltage between the first electrical terminal and the second electrical terminal when RF-electromagnetic radiation falls to the antenna loop, an electrically conductive parasitic radiator disposed to receive RF-electromagnetic energy from the antenna loop via an mutual electromagnetic coupling over an electrically insulating area, and to emit a part of the received electromagnetic energy in a form of RF-electromagnetic radiation to the surrounding space, and to capture RF-electromagnetic energy from RF-electromagnetic radiation falling to the parasitic radiator, and to transfer a part of the captured RF-electromagnetic energy to the antenna loop via the mutual electromagnetic coupling over an electrically insulating area, wherein the electrically conductive parasitic radiator is in a substantially co-planar arrangement with the antenna loop, said electrically conductive parasitic radiator having a length that is approximately one quarter of a wavelength at an operating frequency, and an electrically conductive tuner element disposed to mediate RF-electromagnetic energy between the antenna loop and the electrically conductive parasitic radiator via electrical coupling between the electrically conductive tuner element and the antenna loop and via electrical coupling between the electrically conductive tuner element and the electrically conductive parasitic radiator.

20. A mobile communication device according to claim 19, wherein said mobile communication device is a mobile phone.

21. A mobile communication device comprising according to claim 19, further comprising an electrically conductive part a surface of which is disposed to constitute a ground plane for at least one of the following: the antenna loop and the electrically conductive parasitic radiator.

22. A method comprising:

using an antenna arrangement that includes:

a first electrical terminal and a second electrical terminal, an electrical conductor forming an antenna loop having at least one electrically conductive path extending from the first electrical terminal to the second electrical terminal, the antenna loop being configured to operate as a loop antenna, an electrically conductive parasitic radiator in a substantially co-planar arrangement with the antenna loop, the electrically conductive parasitic radiator being arranged to couple with the antenna loop, said electrically conductive parasitic radiator having a length that is approximately one quarter of a wavelength at an operating frequency, and an electrically conductive tuner element in the vicinity of the antenna loop and the electrically conductive parasitic radiator, the distance between the electrically conductive tuner element and the antenna loon being at a distance to increase capacitive coupling between the antenna loop and the parasitic radiator.

* * * * *

UNITED STATES PATENT AND TRADEMARK OFFICE

CERTIFICATE OF CORRECTION

PATENT NO. : 7,728,785 B2
APPLICATION NO. : 11/350155
DATED : June 1, 2010
INVENTOR(S) : Ozden It is certified that error appears in the above-identified patent and that said Letters Patent is hereby corrected as shown below:

Claim 22, col. 14, line 1 delete "loon" and insert --loop--.

Signed and Sealed this

Twenty-seventh Day of July, 2010

David J. Kappos

David J. Kappos
*Director of the United States Patent and Trademark Office*